US008236113B2

(12) United States Patent
Becker et al.

(10) Patent No.: US 8,236,113 B2
(45) Date of Patent: Aug. 7, 2012

(54) FUEL COMPONENT FOR AN EXPLOSIVE AND METHOD FOR ITS PRODUCTION

(75) Inventors: Claus Willi Becker, Nordhausen (DE); Bernhard Werner Schwark-Werwach, Hamburg (DE); Thomas Matthias Klapoetke, München (DE)

(73) Assignees: Bauer Maschinen GmbH, Schrobenhausen (DE); Claus Willi Becker, Nordhausen (DE); Bernhard Werner Schwark-Werwach, Hamburg (DE); Perforator GmbH, Walkenried (DE)

( * ) Notice: Subject to any disclaimer, the term of this patent is extended or adjusted under 35 U.S.C. 154(b) by 1127 days.

(21) Appl. No.: 12/149,754

(22) Filed: May 7, 2008

(65) Prior Publication Data

US 2010/0051148 A1 Mar. 4, 2010

(30) Foreign Application Priority Data

May 10, 2007 (EP) ..... 07009414

(51) Int. Cl.
*D03D 23/00* (2006.01)

(52) U.S. Cl. ..... 149/109.6; 149/1

(58) Field of Classification Search ..... 149/19.93, 149/109.6, 1
See application file for complete search history.

(56) References Cited

U.S. PATENT DOCUMENTS

| | | | | |
|---|---|---|---|---|
| 6,620,356 | B1 * | 9/2003 | Wong et al. | 264/41 |
| 6,865,878 | B2 * | 3/2005 | Knuth et al. | 60/258 |
| 2004/0232583 | A1 | 11/2004 | Monsheimer | |
| 2005/0189051 | A1 | 9/2005 | Lo et al. | |

FOREIGN PATENT DOCUMENTS

| | | |
|---|---|---|
| DE | 100 63 198 | 3/2002 |
| FR | 971227 | 1/1951 |
| GB | 424733 | 2/1935 |
| WO | WO 99/12870 | 3/1999 |
| WO | WO 03/087017 | 10/2003 |

OTHER PUBLICATIONS

Connelly et al. "Effect of Sorbed Pennetrants on the Aging of Previously Dilated Glassy Polymer Powders. I. Lower Alcohol and Water Sorption in Poly (Methyl Methacrylate)", J. Appl. Polym. Sci., Aug. 5, 1987, Bd. 34, Nr. 2, pp. 703-719.

Stewart et al. "Characterization of Physical Aging of Poly (Methyl Methacrylate) Powders by a Novel High Pressure Sorption Technique", J. Appl. Polym. Sci., Sep. 20, 1989, Bd. 38, Nr. 6, pp. 1111-1126.

Handa et al. "High-Pressure Calorimetric Study of Plasticization of Poly (Methyl Methacrylate) by Methane, Ethylene, and Carbon Dioxide", J. Polym. Sci. Part B: Polymer Physics, Nov. 15, 1996, vol. 34, pp. 2365-2639.

* cited by examiner

*Primary Examiner* — Aileen B Felton
(74) *Attorney, Agent, or Firm* — Jacobson Holman PLLC

(57) ABSTRACT

The invention relates to a fuel component for an explosive, in which case the fuel component contains a volume-expanded molecularly dispersed hydrocarbon, and a method for its production. Furthermore, the invention relates to an explosive formed of the fuel component and an oxidizer, an explosive body filled with the explosive as well as an explosion method.

12 Claims, No Drawings

FUEL COMPONENT FOR AN EXPLOSIVE AND METHOD FOR ITS PRODUCTION

BACKGROUND OF THE INVENTION

1. Field of the Invention

The invention relates to a fuel component for an explosive and a method for its production.

Furthermore, the invention relates to an explosive comprising an oxidizer and a fuel component, an explosive body as well as an explosion method.

2. Description of Related Art Including Information Disclosed Under 37 CFR §§1.97 and 1.98

As explosive substances solid, liquid and gaseous substances or substance mixtures in a metastable state are known in the broadest sense that are capable of a quick chemical reaction without the addition of further reactants. Substances also belonging to this category are those that are not produced for the purpose of blasting or firing, such as e.g. fertilizers, gas-generating agents of the foam and plastic industry or various catalysts.

Explosives are a subgroup of explosive substances that are solid, liquid and gelatinous substances and substance mixtures produced for the purpose of blasting or propelling, see e.g. Köhler, J. and Meyer R. in "Explosivstoffe", VCH Verlagsgesell-schaft mbH Weinheim 1995.

The triggering of an explosive reaction can be brought about by mechanical loads (impact), friction, thermal effect or by a detonation impact.

In the classical explosives that are commonly used in the military and civil sectors the reactants are in most cases present in a combined form, e.g. oxygen is present as a nitrate or a nitro-group.

Compared to the liquid-oxygen-explosive to be used and developed according to the invention the drawback is that in all classical explosives a part of the chemical-exothermal reaction energy has to be used to release the actual reactants "fuel" and/or "oxidizer" from their chemical additive bonds. As a result, the specific exothermal release of energy is lower as compared to liquid-oxygen-explosives.

Another drawback is that environmentally harmful substances develop or remain due to both the reactants themselves and explosives that have not been ignited.

In addition, the current legislation with regard to explosives (hazard caused by storage, transportation and supply of a machine system with explosives), protection of the environment and the danger of terroristic abuse stand in the way of a usage in accordance with the invention of classical explosives for the stripping of rock, as practiced in a similar manner by Louie with C4-explosives in 1973, see in William C. Mauer, "Advanced Drilling Techniques", Petroleum Publishing Co., 1421 S. Sheridan, P.O. BOX 1260, Tulsa, Okla. 74101.

In the last few decades examinations have been carried out with regard to the aspect of non-contamination of the environment by environmentally harmful explosive components, such as e.g. nitrates. Among the explosives that meet these requirements are ranked e.g. nitrogen-free oxidizers, sodium perchlorate or special water-gel-emulsion explosives or also peroxidic and liquid oxygen-based explosives, as disclosed for example in U.S. Pat. No. 5,920,030.

By the term liquid-air-explosives or liquid-oxygen-explosives various explosives have been known for about 100 years. These explosives are produced by soaking fuel such as wood or cork dust, peat litter, carbene and other substances in liquid oxygen. The first systematic scientific works in this field were carried out by the Kaiser-Wilhelm-Institut in Berlin in the 1920s: see e.g. Zeitschrift für angewandte Chemie, 37. volume p. 973-992 dated 11 Dec. 1924 No. 50. Within the framework of these works substances such as carbene, soot, cork dust, peat dust and wood dust, cellulose and coal dust were examined.

The best reaction results were achieved with a mixture of carbene and liquid oxygen (LOX) through enclosure in a damming iron tube: approximately the detonation rate of guhr-dynamite, up to 5600 m/s. Having the summation formula $C_{12}H_{10}$ carbene results from the polymerization of acetylene ($C_2H_2$) on Cu-catalysts as a finely dispersed cork-like substance.

As of 1924 the use of carbene was considered for a long time to be the best solution for the application in LOX-based explosives. However, on the one hand carbene is expensive to produce and on the other hand the transformation only takes place as a detonating reaction if the LOX-carbene-mixture is enclosed in a fixed damming, e.g. in an iron tube.

As early as in 1924 tests showed that the LOX-based explosives belong to the richest energy type blasting agents and bring about great cost advantages.

The drawback in the liquid-oxygen-explosives known so far is that these explosives cannot be used in the sense of the invention because on the one hand they only transform in a detonating manner through sufficient damming and on the other hand their detonation rate is too low. If, for the purpose of rock stripping, explosive charges had to be enclosed e.g. in an iron casing, this would correspond to the use of military fragmentation grenades which is no longer permitted in the civil sector. Moreover, the quantity of material to be removed from the working face would be polluted with steel fragments and, not least, the economic efficiency of such a method would be poor.

Parallel to the works of the Kaiser-Wilhelm-Institut explosive substance mixtures were described e.g. by P. E. Haynes in U.S. Pat. No. 1,508,185 that consist of a mixture of the oxidizer LOX or liquid ozone together with gases liquefied at temperatures below zero degrees centigrade such as $CH_4$, $C_2H_6$, $C_3H_8$, $C_2H_4$, $C_3H_6$ or other similar substances and are furthermore added with absorbing substances. As sorbing substances inert or also combustible substances as for example wood powder, more particularly balsa wood powder, were employed. One of the purposes for this was to increase the time in which the explosive is ignitible, as both fuel and oxygen evaporate.

The drawback of using hydrocarbons as fuel, which are present in a liquid state at temperatures below zero degrees centigrade, lies in the handling that does not ensure a fine distribution of the components without further processing.

From U.S. Pat. No. 4,074,629 the use of a charge configuration is known that provides liquid methane and LOX in separate containers which are then mixed by a conventional detonator blasting charge and induced to a proper detonating transformation.

Likewise, in U.S. 2003/0089434 A1 methods are described how liquid methane and oxygen can be combined to an explosive mixture.

In WO 92/07808 a cryogenic fuel is described that can be used for the application in propelling techniques for supersonic aircrafts below and above the water but can also be used as an explosive. Depending on the application various additional equipment is employed for the production of the combustible or explosive mixture and for the controlled initiation of the combusting or explosive transformation. Here the fuel main component is liquid hydrogen in a form or in the form of mixtures with solid substances and in addition methane, ethane, acetylene and others are added. As oxidizer use can be made of LOX, air, fluorine or other substances having an oxidizing effect.

However, in these methods of generating a LOX-explosive there is the drawback that, for the purpose of a rapid mixing, technologies of such kind would require complicated and expensive equipment in each explosive capsule.

The application of the liquid hydrogen technology for the utilization of the LOX-explosive in accordance with the method can be ruled out for safety and efficiency reasons.

BRIEF SUMMARY OF THE INVENTION

Starting from this prior art the invention is based on the object to provide a highly reactive fuel component for a strong explosive capable of detonating in an undiluted manner as well as a cost-efficient method for its production, whereby safe handling of the fuel component can be ensured and the explosive, if detonation has not taken place, shows a good environmental compatibility.

The object is solved by the invention by a fuel component for an explosive in which the fuel component has a volume-expanded molecularly dispersed hydrocarbon, as well as by a method for its production including the steps of providing a fuel base component consisting of a solid polymer molecularly dispersed hydrocarbon and restructuring, in particular volume expansion of the fuel base component. As a result of the restructuring according to the invention, in particular the volume expansion, a volume-expanded structure of the fuel base component is created.

DETAILED DESCRIPTION OF THE INVENTION

In the method according to the invention the molecules of the fuel component are at first present in a molecular structure and in a solid form of bulk material. Under normal gravity conditions this macromolecular arrangement assumes a packing density that does not leave sufficient space for the reception of oxidizers in the packing volume or for substances to be sorbed, since the molecules of the fuel base component move freely and arrange themselves in a compact manner. However, in order to create a space inside the fuel volume that reaches up as far and into the molecular dimensions and serves both for the reception or incorporation of additional fuel components in the form of hydrocarbons and oxidizers, by the method according to the invention the molecular arrangement of the fuel base component is put through the admixing of a liquid alcohol into a somewhat agglutinated or cross-linked state that contains and allows for the development and existence of inhomogeneities and hollow spaces of a microscopic dimension, which is referred to in the following under the term volume-expanded structure.

The generation and stabilization of such a volume-expanded structure as a volume adaptation in the fuel is useful in order to adjust and maintain in the finished liquid-oxygen-explosive-mixture a required volumetric proportional relation between the components fuel and oxidizer so as to achieve the quick and explosive reaction sequence. In the present case according to the invention a volume expansion is preferably adjusted. However, the opposite case of volume decrease or of keeping the average volume constant is possible, too. If the fuel accounts for example for only 15% to 20% of the total volume, in which it spreads in a structured manner, and if the rest is accounted for by the oxidizer, the insufficient fuel density could lead to the fact that an explosive transforming reaction triggered locally in the mixture could be stopped or extinguished or a progress through the mixture that is too slow might occur. In such case it is useful to adjust according to the same methodical procedure a volume structuring or adaptation through an absolute decrease of the volume share of the fuel component. Such a decrease of the volume share also falls under the process of creating a volume-expanded structure. For in the inside of the fuel volume inhomogeneous and anisotropically distributed microstructured portions are created and fixed.

Following the mixing of the fuel base component with a liquid alcohol and the subsequent desorption of the alcohol by the fuel component a loose volume-expanded structure of the macromolecular bulk-material-compound remains. Through the admixing of a liquid alcohol and its desorption the ensemble of the fuel base component is brought into a collective volume-expanded state that distinguishes itself by the fact that additional intra-molecular distances and spaces develop between the macro-molecules of the fuel base component.

A comparable selective spatial cross-linking, the so-called "crunching", can also be achieved by measures such as solubilization, heating, exposure to radiation and agglutination.

The bulk-material-like molecular compound of the fuel base component, that has the tendency before the alcohol treatment to assume a packing density as high as possible, is now mixed or "crunched" to a lower integral density so that despite the still existing macromolecular structuring a sufficiently large, homogeneously distributed volume of free spaces is spread in the packing of the bulk material. The admixing of the alcohol ensures that the molecules of the fuel base component are deformed spatially and also partly cross-linked which is in part brought about in a chemical manner and mainly through physical interactions. After the expulsion of the alcohol from the mixture the loose structure of the macromolecular bulk-material-compound thus obtained is left over.

The kind and quantity of the admixed alcohol and the mechanical mixing process determine the degree of the collective volume expansion or density decrease in the molecular ensemble. As a rule, however, the result of this step of preparing the spatial conditioning of the fuel for a quick and easily initiable reactivity with an oxidizer that is perhaps added normally still is a bulk-material-like solid substance or respectively a granulate consisting of porous particles.

For best suitability the volume-expanded fuel base component is mixed with a combustible low-molecular hydrocarbon in order to form a conditioned fuel component.

If specific, preferably liquid hydrocarbons are admixed in connection with the admixed alcohol or afterwards, the formation of a body consisting of molecules of the fuel base component that is in itself compact and self-supporting is rendered possible. The fuel bodies assume a space that reaches up as far and into the molecular dimension and is as large as the loose conditioned granulate. Unless having partially been added-on chemically, these admixed components are expelled again from the fuel body after the formation thereof.

During the process of expulsion of the admixed volume-expanding substances the desired desorption of further molecules sorbed in the molecular compound of the fuel base component, such as carbon dioxide, water, nitrogen and other substances sorbed therein, takes place at the same time.

The desorption and therefore the purification of the boundary portions of such reaction-inhibiting substances can be effected e.g. through vacuum, the influence of temperature, exposure to radiation or by means of cleaning agents that are expelled themselves afterwards. The desorption of molecules added on in the fuel base component leads to the fact that on the energetic level of physical bonding a kind of radicals or defective parts are developed that have the tendency to pick up moisture, carbon dioxide and other substances from the atmosphere in a sorptive manner and add these on at the defective parts. In order to prevent this process from taking place, another advantageous method step of preparing the fuel component for a quick reactivity resides in the fact that only combustible hydrocarbon molecules with a low to medium number of carbon atoms per molecule, preferably ranging from $C_1$ to $C_{10}$, is resorbed in the purified molecular fuel compound.

Hence, in the fuel base component substances are selectively added on that promote a quick transformation. These can also be catalysts.

These preparatory operations or procedures for a readily conditioned fuel component according to the invention or for a fuel mixture with specific properties, which determine a quick detonating reactivity and a reaction-triggering sensitivity that can be set optionally beforehand, mainly fall under the term "conditioning" of the fuel.

The readily conditioned fuel component is in itself non-hazardous and does not belong to the class of explosives and due to the fact that the sorbed and incorporated hydrocarbons have a low volatility the fuel component can be classed in the strictest sense as a hazardous material within the meaning of combustible dusts.

Preferably, as the fuel base component, a spray-dried emulsion-polymer or -condensate is used. Such a polymer can be produced in a relatively simple and cost-effective manner and has an extremely high specific surface that accounts for a very high reactivity of the fuel.

As fuel base component usage is preferably made of polymers of the methacrylate class, preferably methylmethacrylate or ethylmethacrylate or mixtures thereof. However, as fuel base component any other kinds of hydrocarbon-based molecules can be used if they are present under normal thermal conditions as a solid material having a molecular structure.

Other powdery or molecular fuel components, such as e.g. melamine, solid alcohols or small proportions of balsa wood powder, can be admixed optionally. However, the total volume share admixed should not exceed 50%. Advantageously, the conditioning step of the volumetric transformation of the fuel base component for the purpose of an increased incorporation capacity for oxidizers is effected with methanol or ethanol or a mixture of these two substances. Propanol and butanol are suitable, too.

It is of advantage if methane or ethane or a mixture thereof is used as a combustible low-molecular hydrocarbon. Use can also be made of other alkanes of the lower number of carbon atoms, such as for instance propane, butane or pentane or mixtures thereof or chemical derivatives based on their basic molecule or number of carbon atoms.

In a particularly preferred embodiment of the method according to the invention the combustible low-molecular hydrocarbon is added together with a liquid hydrocarbon. The fuel purified during the desorption phase is able to sorb low-molecular hydrocarbons of high volatility, such as methane or ethane, only in traces and keep them incorporated for a sufficient time period. If, during the aeration with methane gas, the pressure balancing is completely effected onto the ambient pressure, the removal of the fuel from the equipment is then of course accompanied by the evaporation of methane proportions that have not been sorbed.

In order to keep an additional amount of methane in the fuel besides the sorbed proportion, the final pressure balancing phase can be effected through injection with higher hydrocarbons that are still highly volatile under normal atmospheric conditions. For example liquid butane, pentane, hexane or higher and similar hydrocarbons can be specifically admixed with the fuel component. However, only such an amount should be admixed at the maximum that the bulk-material-like or solid state of the fuel is not affected altogether. As especially effective additives pentane, hexane and isooctane are suitable.

The afore-described conditioning procedures or their individual partial steps produce sufficient free space in the fuel component in order to be capable of adjusting desired ignition sensitivities and detonating reaction and transformation rates for a mixture containing an oxidizer.

In a further preferred embodiment of the method according to the invention the fuel base component is mixed, before or during the mixing with the alcohol, with a further additional fuel base component in the form of a molecularly dispersed organic solid substance. This additional fuel base component enlarges the property range of the fuel and the possibility to adapt the respective ignition sensitivities and detonating trans-formation rates to the corresponding applications. As additional fuel base component powdery fuel components, such as melamine, solid alcohols or balsa wood powder are especially suitable.

For best suitability the mixture is exposed to microwave radiation before completion. As a result of a dosed microwave radiation the volume-expanded state produced through the afore-mentioned conditioning procedures is fixed microscopically and macroscopically in the substance as a self-supporting shaped body. At the surface a stable film can be formed that can develop through polymerization.

It is useful to carry out desorption by means of vacuum-drying, -desorption or -freeze-drying. These methods ensure a quick and efficient expulsion of alcohol and other undesired substances. As a result of the desorption of these reaction-inhibiting substances from the fuel the activity and reactivity of the fuel component is enhanced further. The desorption phase can equally be brought about through the effect of an increased temperature or through irradiation, for example with microwaves.

In the following the method according to the invention is described in greater detail by way of an embodiment.

15 g of a dry molecular methylmethacrylate substance are well mixed with approximately 5 ml of ethanol. Then approximately 8 ml of iso-octane are admixed. Caution is needed here to prevent loss through evaporation. The mixture is spread into an electrically non-conductive mould and exposed to microwave radiation. The duration of radiation depends on the frequency and power density of the radiation source. In a regular 800 W household microwave device the duration ranges between 30 and 60 seconds depending on the spread packing density and the total volume of the shaped body. During radiation exposure the interaction of the methylmethacrylate and ethanol molecules with the additive iso-octane should only lead to a sintering of "molecule tips". The body exposed to radiation should not heat over 40° C. for a longer time period, because otherwise agglutinating blends might develop.

The subject matter of the invention also resides in a fuel component for an explosive, which has a volume-expanded molecularly dispersed hydrocarbon that is produced according to the above-mentioned method.

A further aspect of the invention relates to an explosive comprising an oxidizer and the fuel component according to the invention.

Especially suitable as oxidizer are halogens, more particularly fluorine, inter-halogen-compounds, halogen-oxygen-compounds as well as all oxygen modifications.

Particularly suitable is an explosive, in which the oxidizer comprises liquid oxygen.

Apart from the reaction-induced cleavage of the hydrocarbon and oxygen molecules in atomic modification, such a mixture consisting of the fuel component according to the invention and liquid oxygen, a so-called LOX-ex-mixture, only consists of exothermal reactants. After the initiation of the reaction all components of the mixture are directly available through the quick and complete energetic transformation and do not have to be released or set free chemically from metastable additive states through parallel running e.g. endothermal secondary reactions. The explosive according to the invention can be classed with the group of the strongest existing explosive materials. As the fuel component of the liquid-oxygen-explosive, specific polymolecular or macromolecular hydrocarbon molecules are present in the condensed state as individual molecules and yet as a bulk material, which are brought into such a state through conditioning such that after their mixing with liquid oxygen the fuel components find their oxidizer partners located directly next to one another. As a result, the achievement is made that even the local introduction of impact or blow energy into the volume of the mixture triggers a detonating transformation reaction with a sufficiently high reaction rate. The volume of the liquid-oxygen-explosive-mixture is sized in its entirety. Due to the fact that the fuel components and their oxidizer partners are arranged directly next to one another, a chemically high reactive energy density and, following the ignition, a high detonating reaction or transformation rate is achieved in the mixture. The liquid-oxygen-explosive consists of components which are as such no explosives and in which no chemically energetic ballast, such as chemical oxidizer carriers, are contained.

Due to the sequence of the above-stated preparatory operations of the fuel component the achievement is made that the microstructured and nanostructured macromolecular-compound produces a sufficient volume in itself. Through this a reaction-induced optimal volumetric proportional relation is given between the fuel and the oxidizer. In particular, in the mixing phase the fuel and oxidizer partners are distributed spatially in such a manner that the potential partners in the explosive mixture are located next to one another or are kept reactive in a stable mixing state for as long as a sufficient amount of cryogenic liquid oxygen is available that penetrates the fuel volume. The explosive according to the invention distinguishes itself by a number of advantageous properties:

A high detonating reaction or transformation rate of the entire LOX-ex-volume. The triggering of the entire detonating reaction can be effected through the influence of shock, impact, friction or pressure from a small volume proportion of the LOX-ex-charge. The LOX-ex-mixture does not contain any ballast and therefore possesses a high chemical reactive energy density. Moreover, the explosive has a high rock stripping capacity. The mass-related costs for an explosive lie in the range of the costs for fuel oil, while the fuel and the liquid oxygen are per se no explosives and do not require any explosive-specific safety measures until being mixed into the LOX-ex. The regulation for hazardous goods is applicable in the strictest sense to the basic substances of the LOX-ex-mixture. The fuel, the liquid oxygen as well as the completed LOX-ex-mixture and the explosive reaction products or the remainder left over after misfiring are not harmful to the environment. A produced LOX-ex-mixture that was not ignited returns very quickly through evaporation of the cryogenic liquid oxygen into the non-explosive status and is therefore non-hazardous. Likewise, a flame ignition does not occur in an exposed LOX-ex-mixture. The mixture then burns off explosively just as in the case of black powder for example. However, the detonating pressure impact of a transforming LOX-ex-mixture initiates the detonating reaction of a LOX-ex-mass positioned adjacent thereto. Moreover, the combining of the fuel with the liquid oxygen to the LOX-ex-mixture can take place manually or in an automated manner.

The subject matter of the invention also resides in an explosive body comprising the explosive according to the invention.

The LOX-ex-mixture can be easily filled into capsules produced of different materials, in particular materials that are easily biologically degradable, such as cardboard. Or the LOX-ex-mixture is directly produced with an enveloping capsule as skin made of the fuel component itself so that LOX-ex-capsules are made available. The LOX-ex-capsules can be accelerated pneumatically according to the blow-pipe-principle and fired at a target location, in which case the explosive properties are maintained. The required ignition impulse can be applied for example by a specific detonation igniter, through enclosure of the LOX-ex-mixture in a pressure container and subsequent pressure increase or through a collision of the LOX-ex-capsule with an obstacle.

In connection with a collision the detonating ignition can also be brought about by a mechanically passive and non-reactive ignition device arranged specifically in the LOX-ex-mixture. In the simplest case such an ignition device consists of one or several metallic or mineral solid bodies that are suitably placed in the charge. During the firing acceleration of the capsule these bodies remain in their resting position and at the moment of collision or impact of the LOX-ex-capsule onto an obstacle an advance movement of the bodies in the LOX-ex-mixture takes place due to their inherent inertia. As a result, a pressure-impact wave with reaction-triggering strength and frictional effect gathers in front of such a body. Or such an incorporated body strikes like a ram onto an obstacle included in the capsule according to the hammer-anvil-principle and initiates a pressure impact or a compressive impact effect whereby the entire chemical transformation is triggered in a detonating manner.

If the LOX-ex-charge is designed as a hollow charge, a suitable ignition at the moment of impact of the capsule is also possible in that such a body of inertia or ram located inside the charge strikes against the mechanically stabilized tip of the conical material or its axial extension and into the interior of the capsule where it ignites the LOX-ex-mixture.

By preference, a dynamic inertia damming is provided in the explosive body.

The effect of the dynamic inertia damming takes place at the moment of impact of the capsules and their detonating transformation. For example the rear part of the capsule is designed as a solid inert mass, which, due to its mass-inertia, sets up a diffusion resistance until the time of its own destruction against the rearward directed detonating effect of the capsule and thereby enhances the destructive forward effect. The inert mass can be concrete for example. Due to its mass inertia this concrete body generates a dynamic damming that prevents the detonation pressure from escaping completely unhindered into the rearward free space.

The explosive body according to the invention is particularly suitable for application in an automated rock-stripping method. To increase the directed rock-stripping or damaging capacity the LOX-ex-charge can preferably be designed geometrically as a hollow charge.

In accordance with a further aspect of the invention an explosion method is proposed. Here a fuel component according to the invention is mixed directly before an explosion with an oxidizer in order to form an explosive. Therefore, the individual components can be stored in a protected place for a longer period of time and transported separately so that the safety risk can be reduced considerably. Moreover, the reactivity of both components, in particular directly after the mixing, is noticeably higher as compared to a point in time after longer storage whereby an increased detonating effect can also be achieved.

The invention claimed is:

1. A method for producing an explosive with detonating reactivity, comprising the steps of:

spray-drying a fuel base component consisting of exothermal reactants and including at least an emulsion polymer of methyl-methacrylate to produce a fuel base component having a high specific surface, conditioning the high specific surface fuel base component to bring the fuel base component into a condensed state of individual macromolecules, and adding liquid oxygen as an oxidizer to the conditioned fuel base component to produce an explosive with detonating reactivity, in which the macromolecules of the fuel base component are located directly next to their oxidizer partners.

2. The method according to claim 1, further comprising the step of restructuring the fuel base component by selective spatial cross-linking, prior to the conditioning step.

3. The method according to claim 2, wherein the selective spatial cross-linking of the fuel base component is achieved by one of solubilization, heating, exposure to radiation, and agglutination.

4. The method according to claim 1, further comprising the step of restructuring the fuel base component, prior to the conditioning step, wherein the fuel base component is mixed with a liquid alcohol and the alcohol is desorbed by the fuel base component to achieve volume expansion of the fuel base component.

5. The method according to claim 1, wherein in the conditioning step, the volume-expanded fuel base component is mixed with a combustible low-molecular hydrocarbon in order to form the conditioned fuel component.

6. The method according to claim 4, wherein the alcohol is methanol or ethanol or a mixture thereof.

7. The method according to claim 5, wherein the combustible low-molecular hydrocarbon is methane or ethane or a mixture thereof.

8. The method according to claim 4, wherein before or during mixing with the alcohol in restructuring step, the fuel base component is mixed with a further additional fuel base component in the form of a molecularly dispersed organic solid substance.

9. The method according to claim 5, wherein in the mixing step, the combustible low-molecular hydrocarbon is added together with a liquid hydrocarbon.

10. The method according to claim 9, wherein the liquid hydrocarbon is iso-octane.

11. The method according to claim 1, further comprising the step of exposing the mixture to microwave radiation prior to the step of adding liquid oxygen.

12. The method according to claim 4, wherein desorption is carried out by means of vacuum-drying, -desorption or -freeze drying.

* * * * *